US009987680B2

(12) United States Patent
Freakes

(10) Patent No.: US 9,987,680 B2
(45) Date of Patent: Jun. 5, 2018

(54) IMPACT CASTING METHODS AND DEVICES

(71) Applicant: Anthony Freakes, Lawrenceville, NJ (US)

(72) Inventor: Anthony Freakes, Lawrenceville, NJ (US)

( * ) Notice: Subject to any disclaimer, the term of this patent is extended or adjusted under 35 U.S.C. 154(b) by 149 days.

(21) Appl. No.: 15/163,089

(22) Filed: May 24, 2016

(65) Prior Publication Data

US 2016/0346834 A1 Dec. 1, 2016

Related U.S. Application Data

(60) Provisional application No. 62/166,033, filed on May 25, 2015.

(51) Int. Cl.

| | |
|---|---|
| ***B22D 27/08*** | (2006.01) |
| ***B22D 33/00*** | (2006.01) |
| ***B22D 17/00*** | (2006.01) |

(52) U.S. Cl.
CPC ..... *B22D 27/08* (2013.01); *B22D 17/00* (2013.01); *B22D 33/00* (2013.01)

(58) Field of Classification Search
CPC ..... B22D 17/00; B22D 27/08; B22D 33/00
See application file for complete search history.

(56) References Cited

U.S. PATENT DOCUMENTS

| | | | | |
|---|---|---|---|---|
| 5,878,804 | A * | 3/1999 | Williams | B22D 17/007 164/103 |
| 2014/0144199 | A1* | 5/2014 | Shigihara | B21J 5/025 72/342.94 |
| 2014/0290897 | A1* | 10/2014 | Chuntonov | B22D 39/02 164/303 |

* cited by examiner

*Primary Examiner* — Kevin E Yoon
(74) *Attorney, Agent, or Firm* — Timothy X. Gibson, Esq.; Gibson & Dernier LLP

(57) ABSTRACT

A method of removing voids from a casting is disclosed including the steps of introducing molten metal into a die, providing an impact surface and dropping the die containing the molten metal at least once from a predetermined height to strike the impact surface. A device for removing voids from a casting includes a base, a drive means operably coupled to at least one cam, and a guide configured to receive a die, wherein the at least one cam is positioned on the base to contact a die placed on the guide, and wherein rotation of the at least one cam is operable to raise and subsequently release the die to strike a surface of the base, and wherein the guide maintains the die in a stable orientation relative to a horizontal axis of the base.

4 Claims, 1 Drawing Sheet

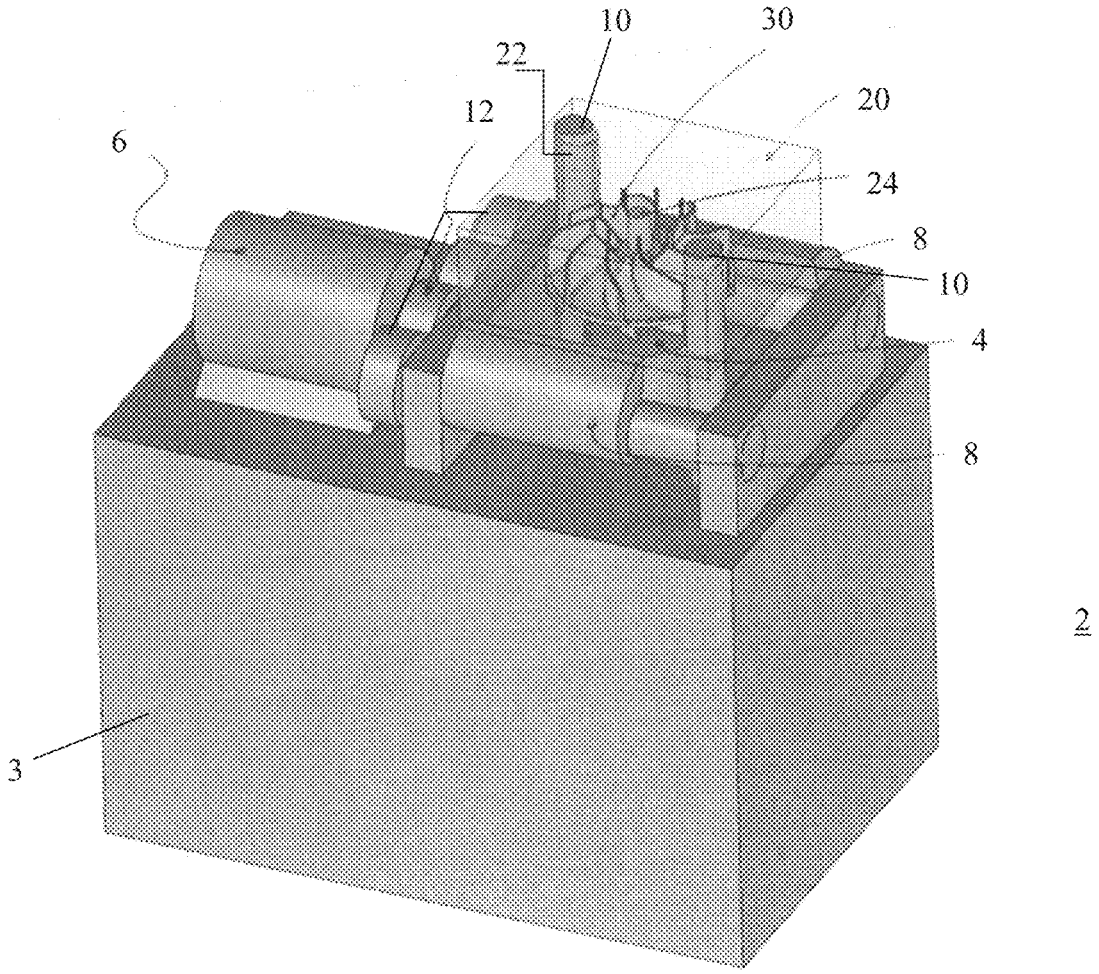
10
30
22
20
12
6
24
8
10
4
8
2
3

IMPACT CASTING METHODS AND DEVICES

CROSS-REFERENCE TO RELATED APPLICATIONS

This application claims the benefit of U.S. Provisional Patent Application No. 62/166,033 filed May 25, 2015, the entirety of which is incorporated herein by reference.

FIELD OF THE INVENTION

This invention relates to casting and in particular to devices and methods for casting metals.

BACKGROUND OF THE INVENTION

There are various methods of casting metals into usable shapes, such as sand casting, steel die casting, steel die casting under pressure, centrifugal casting and rubber mold spin casting. All have their appropriate use depending on the metal being cast and the requirements. These requirements may include typically accuracy and density. One important condition, which in applications involving safety may be considered a defect, is porosity. Porosity is the natural condition resulting from the melting and pouring of metal. Air and other gases are mixed in with the molten slurry and are transferred into the forming cavity. Unfortunately, the natural cooling rate does not give enough time for the gases to escape and they become locked within the casting, and can be seen in an x-ray as voids, randomly dispersed. This is the natural result of "static" casting. In the casting of nonmagnetic metals, there is no method known which can control where the voids are placed if the casting is static, that is, if the forming cavity remains stationary. Thus there is a need for a method of casting which addresses the problem of uncontrolled porosity.

SUMMARY OF THE INVENTION

Embodiments disclosed herein address the problem of uncontrolled porosity in casting metals. In accordance with one embodiment a method is disclosed which employs gravity to eliminate voids.

In accordance with one or more embodiments, a method of removing voids from a casting includes introducing molten metal into a die, providing an impact surface and dropping the die containing the molten metal at least once from a predetermined height to strike the impact surface. The method may include dropping the die repeatedly from the predetermined height to strike the impact surface. The step of dropping the die repeatedly may include dropping the die at a predetermined frequency. The method may further include raising the die containing the molten metal to the predetermined height prior to dropping the die.

In accordance with other embodiments, an apparatus for removing voids from a casting includes a base, a drive means operably coupled to at least one cam, and a guide configured to receive a die, wherein the at least one cam is positioned on the base to contact a die placed on the guide, and wherein rotation of the at least one cam is operable to raise and subsequently release the die to strike a surface of the base, and wherein the guide maintains the die in a stable orientation relative to a horizontal axis of the base. The base of the apparatus in some embodiments includes an impact pad positioned on a surface of the base to receive impact of the die when the die is released.

In some embodiments the guide includes at least one post configured to fit into a complementary bore formed in the die. The apparatus may include plural posts to serve as a guide.

In operation, the entire die together with a fill of molten metal is raised and then dropped a predetermined distance until it is abruptly brought to a stop by impacting on a massive body, such as the base or an impact pad. The average force of the impact is very high and forces the molten metal downwards while the lighter weight gases and dross are forced upwards, whereupon after solidification it can be removed. As the die is returned to the initial position for a subsequent drop, the acceleration of the lifting action produces a reactive force in the molten metal which again is in the downward direction, and again causes the lighter materials to move upwards. The impact and the return to the initial position may be repeated as many times as desired until all voids are eliminated from the final product.

In another embodiment, a device is disclosed which is operable to perform the method.

BRIEF DESCRIPTION OF THE DRAWINGS

So that those having ordinary skill in the art will have a better understanding of how to make and use the disclosed systems and methods, reference is made to the accompanying FIGURES wherein:

FIG. 1 is a perspective view of a device in accordance with one or more embodiments of the present invention.

DETAILED DESCRIPTION OF THE INVENTION

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the FIGURES. It will be understood that the spatially relative terms are intended to encompass different orientations of the device in use or operation in addition to the orientation depicted in the FIGURES. For example, if the device in the FIGURES is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

With reference to FIG. 1, a device 2 for removing voids from a casting 30 includes a base 3, a drive means 6 such as but not limited to a motor, and one or more lifting cams 8 operably coupled to the drive means 6, for example via gearing 12 or the like. The drive means 6 may be coupled to the lifting cams 8 using any well known means, such as but not limited to gears, belts, etc. The device 2 is operable, when the drive means is actuated, to move a die 20, shown as a transparent block, upward relative to the base 4 and release the die 20 to drop it onto the impact pad 4. The die 20 may be linearly guided or pivoted, so that it reciprocates or oscillates up and down relative to the stationary base 4 according to the rotation of the cam(s) 8.

In one or more embodiments the device 2 may include an impact pad 4 mounted on the base 3. In other embodiments, the base 3 may serve as an impact pad.

In accordance with one embodiment, the device may include one or more guides 10 upon which the die 20 may be mounted. For example, the die 20 may include one or more bores 22 to receive the one or more guides 10. The eccentric shapes of the cams 8 serve to raise and subsequently drop the die 20 onto the impact pad 4 as the cams 8 are rotated. As the cams 8 rotate, the guides 10 maintain the die 20 in a stable orientation relative to the horizontal axis of the base 3, preventing spillage of molten casting 30 due to tipping or the like.

In accordance with a method of operation, a die 20 is positioned on the guides 10. The die 20 may in some embodiments be pre-filled with molten casting 30 via sprue 24 before the mounting operation. In other embodiments molten casting 30 is introduced into the die 20 after mounting. The drive means 6 is actuated and the die 20 is moved up and down relative to the base 3 due to the rotation of the cams 8 while the casting 30 contained therein is still molten. The double impact of the free drop of the die 20 and the upward acceleration of the die 20 compacts the molten metal and forces the gases and dross toward the upper portion of the forming cavity of the die 20.

Without being confined to a single theory, the device 2 operates on the principle that when a body is dropped, under the influence of gravity, it stores work which is the distance dropped multiplied by the weight. When it is abruptly stopped by hitting something massive, the force it exerts is very high because the amount of movement is very small. Hence the method of casting may be called impact casting.

For example, if a magnesium casting weighs 0.375 lbs. and it is dropped, with the die tooling, 1.2 inches, it will store 0.0375 ft. lbs. of work. If upon impact the movement during the deceleration is for example 0.004 inches then the average force experienced during the abrupt stop is 0.0375/0.004=9.375 lbs, or 25 Gs. If the metal and concrete surroundings are very massive, the abrupt stop might only be done in 0.002 inches. If the initial dropping distance is also doubled, the force could be 100 Gs.

Applying these forces in a continuous rhythmic manner by using a rotating cam, the resulting pulsing is a very effective method for moving the air and gas upwards, thus 25 Gs may be adequate for many applications, but the force may easily be increased as described above. As air has much lower mass than magnesium, the work done in falling is less, so air experiences less impact force than the force of the magnesium compression, which therefore pushes the air to the top of the forming cavity of the die 20.

Thus, devices as described herein are useful for making castings almost as dense as forgings. It is believed the methods disclosed herein are more productive and cost effective than centrifugal casting.

Although the devices, systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A method of removing voids from a casting comprising introducing molten metal into a die, providing an impact surface and dropping the die containing the molten metal at least once from a predetermined height to strike the impact surface.

2. The method according to claim 1 comprising dropping the die repeatedly from the predetermined height to strike the impact surface.

3. The method according to claim 2 wherein the step of dropping the die repeatedly comprises dropping the die at a predetermined frequency.

4. The method according to claim 1 further comprising raising the die containing the molten metal to the predetermined height prior to dropping the die.

* * * * *